US005238072A

United States Patent [19]

Hesse

[11] Patent Number: 5,238,072

[45] Date of Patent: Aug. 24, 1993

[54] PIPE RAMMER

[75] Inventor: Alfons Hesse, Lennestadt, Fed. Rep. of Germany

[73] Assignee: Paul Schmidt, Lennestadt, Fed. Rep. of Germany

[21] Appl. No.: 546,671

[22] Filed: Jun. 29, 1990

Related U.S. Application Data

[63] Continuation of Ser. No. 273,408, Nov. 18, 1988, abandoned.

[30] Foreign Application Priority Data

Dec. 7, 1987 [DE] Fed. Rep. of Germany ..... 3741373

[51] Int. Cl.[5] ..... B25D 9/00

[52] U.S. Cl. ..... 173/90; 173/128; 173/206; 405/184

[58] Field of Search ..... 405/184; 173/90, 128, 173/134

[56] References Cited

U.S. PATENT DOCUMENTS

| | | | |
|---|---|---|---|
| 4,460,050 | 7/1984 | Schmidt | 173/131 X |
| 4,650,374 | 3/1987 | Schmidt | 405/184 |
| 4,671,703 | 6/1987 | Schmidt | 405/154 X |

FOREIGN PATENT DOCUMENTS

| | | |
|---|---|---|
| 2502662 | 3/1982 | France . |
| 3247 | 4/1919 | Netherlands . |
| 7907082 | 9/1979 | Netherlands . |

*Primary Examiner*—Mark Rosenbaum
*Assistant Examiner*—Willmon Fridie, Jr.
*Attorney, Agent, or Firm*—Anderson Kill Olick & Oshinsky

[57] ABSTRACT

In a rammer for internal ramming of pipes, having its rear end connected with the rear end (viewed in the direction of advance) of the driven pipe, the application of the driving force is improved by a mechanically simple connection.

5 Claims, 2 Drawing Sheets

PIPE RAMMER

This is a continuation application of Ser. No. 07/273,408, filed Nov. 18, 1988, now abandoned.

TECHNICAL FIELD OF THE INVENTION

The invention relates to a rammer for internal ramming of pipes, for example protective or service pipes.

BACKGROUND OF THE INVENTION AND PRIOR ART

Ramming in of pipes, refereed to hereafter as driven pipes, generally requires a starting trench or shaft in which the rammer and driven pipe are prepared. To reduce the dimensions of the starting trench, it is known from German Utility Model Specification 87 07 158 instead of engaging the impact tip of the rammer with the rear end of the pipe, either directly or by means of a rammer extension, to arrange it in the driven pipe. In this manner the length of the starting trench required is essentially determined merely by the length of the driven pipe.

So that the driven pipe can be rammed in, the known internal rammer is surrounded by a tubular jacket arranged in the driven pipe, with the conical impact tip of the rammer being shaped to engage and fit in an inner ring arranged at the front end of the tubular jacket (viewed in the direction of advance), so that the driving force of the rammer is transferred through the impact tip, which is either moveable or rigidly connected to the inner ring, and thus to the tubular jacket. To reverse the driving force transferred to the tubular jacket and convert it into force for driving the driven pipe forward, an outer collar is provided at the rear end of the tubular jacket (viewed in the direction of advance); which is in contact with the rear end face of the driven pipe. The driving force is thus transferred to the driven pipe via the inner ring, the tubular jacket and the outer collar. In order to avoid rebounds, which occur through the anvil effect of the outer collar of the tubular jacket lying flush on the driven pipe, the rammer and the pipe are clamped together.

OBJECT OF THE INVENTION

The object of the invention is to improve the internal ramming of pipes, and in particular to reduce the mechanical requirements.

BRIEF DESCRIPTION OF THE INVENTION

According to the invention, this object is achieved by connecting the rear end of the rammer with the rear end (viewed in the direction of advance) of the driven pipe, preferably in a form-fitting manner, for which purpose the rear end of the rammer is advantageously provided with a shoulder that narrows in the direction of advance. Because of the connection of the rear end of the rammer or the rammer housing, which may for example be thickened, with the rear end of the driven pipe in accordance with the invention, the driving force of the rammer is applied directly, i.e. without change of direction, to the driven pipe. For this purpose neither an additional pipe surrounding the rammer and provided with a collar, nor a clamping device coupling the driven pipe with the rammer to avoid rebounds, is required.

By means of a connecting piece such as a rammer cone or a rammer segment between the shoulder and the driven pipe the rear end of the rammer, thickened by the shoulder, can be adapted to different diameters of pipe. All that is required is to push one or more connecting pieces corresponding to the internal diameter of the driven pipe on to the rammer shoulder.

BRIEF DESCRIPTION OF THE DRAWINGS

The invention will now be explained in more detail with reference to an exemplary embodiment shown in the drawings, in which.

DETAILED DESCRIPTION OF A PREFERRED EMBODIMENT OF THE INVENTION

Figure 1:
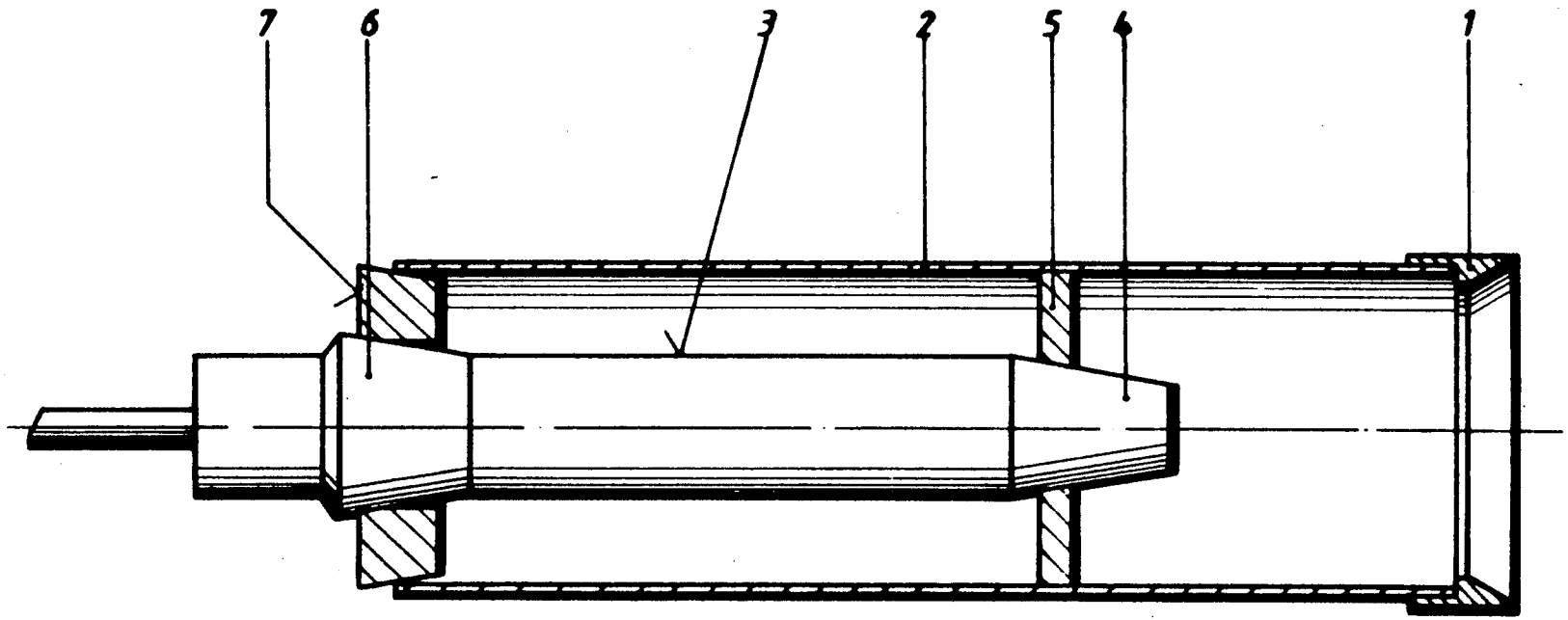
FIG. 1 shows in longitudinal section an internal rammer connected according to the invention to the rear end of the driven pipe through a shoulder at the rear end of the rammer.

Arranged in a driven pipe 2 having at its leading end a cutting shoe 1 is a rammer 3 whose conical impact tip fits into a supporting ring 5. The rear end of the rammer 3 has a shoulder 6 that narrows towards the impact tip 4, and a connecting piece 7 that is pushed on to the shoulder 6 and is formed as a rammer cone, so that the rear end of the rammer 3 is connected by way of the shoulder 6 and the rammer cone 7 to the rear end of the driven pipe 2.

Figure 2:
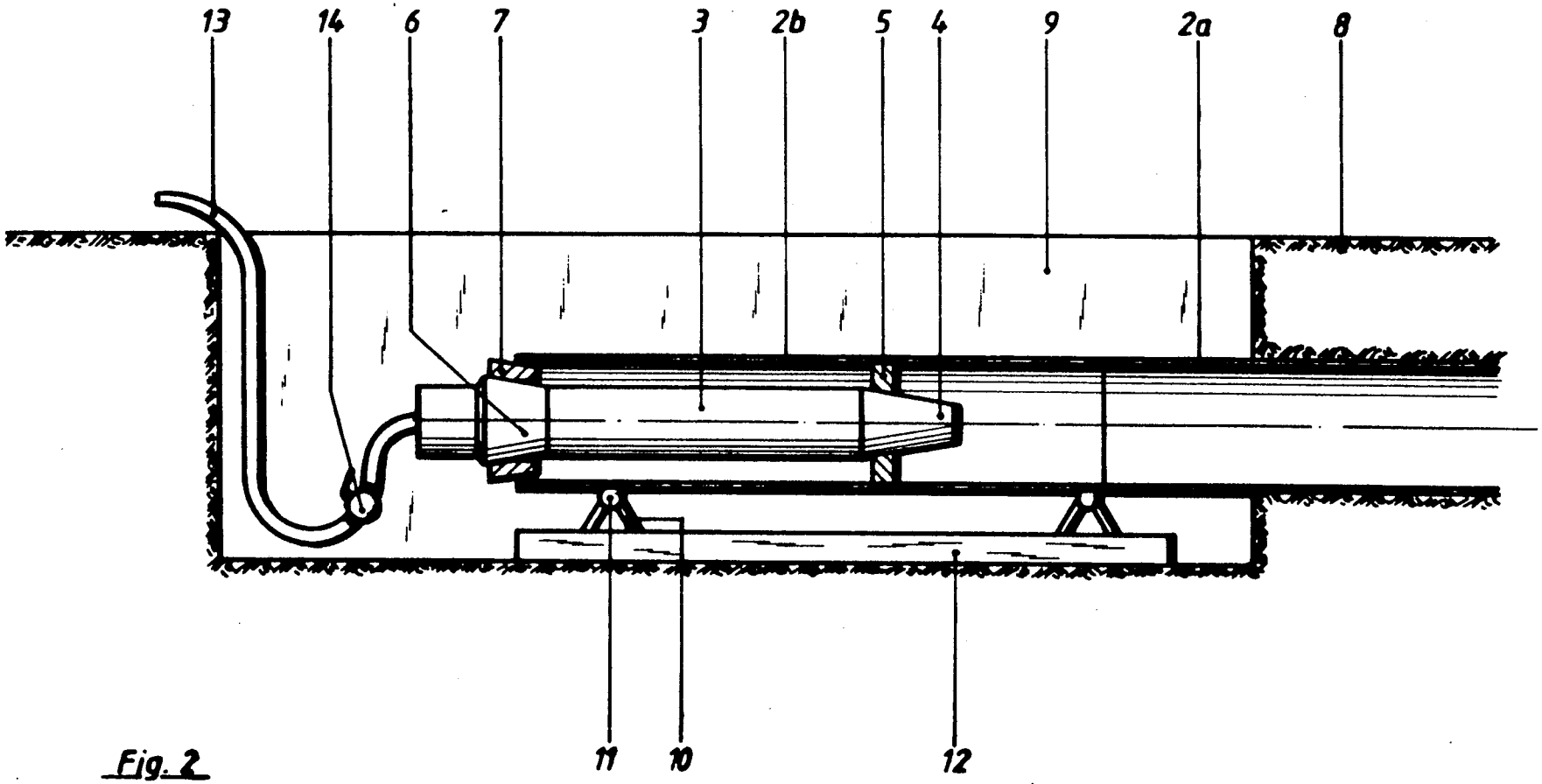
FIG. 2 shows the rammer of FIG. 1 in a starting trench after a following pipe has been attached to a driven pipe that has been rammed almost completely into the ground.

FIG. 2 shows the attachment of a following pipe **2*b* to a driven pipe 2*a* that has been almost completely rammed into the group 8. In the initial position shown, the following pipe 2*b* is in a starting trench 9 and is supported on a ground frame by means of supporting rollers 11 arranged prismatically on stands 10. The rear end of the rammer 3 is connected in a form-fitting manner, by way of the conical shoulder 6 and the intermediate rammer cone 7, to the rear end (viewed in the direction of advance) of the following pipe 2*b***.

An impact piston (not shown) reciprocating in the interior of the rammer 3 and possibly weighing several tons, transmits its impact energy by way of the shoulder 6 and the rammer cone 7 to the following pipe **2*b*, and drives this forward with each blow. As a rule the impact tip is driven pneumatically, hydraulically or mechanically. In the present case compressed air from a compressor (not shown) is led into the interior of the housing of the rammer 3 via an air hose with an integral reversing valve 14**.

What is claimed is:

1. A ramming device arranged inside of a driven pipe so as to transmit a driving force onto a rearward end of the driven pie, comprising a ram with a thickened rearward end relative to the direction of the driving force, and a positively locking connection between the thickened rearward end of the ram and the rearward end of the driven pipe.

2. A ramming device according to claim 1, wherein the rear end of the ram is provided with a shoulder.

3. A ramming device according to claim 2, wherein the shoulder narrows in a direction of advance of the ram.

4. A ramming device according to claim 2, and further comprising at least one connecting piece arranged between the shoulder and the driven pipe.

5. A ramming device according to claim 1, wherein the ram has an impact tip, and further comprising a support ring arranged between the impact tip of the ram and the driven pipe.

* * * * *